United States Patent [19]

Barth et al.

[11] Patent Number: 5,005,321

[45] Date of Patent: Apr. 9, 1991

[54] PROTECTIVE HOOD FOR GRINDING MACHINES, PARTICULARLY ANGLE GRINDERS, AND SUITABLE FASTENING RECEPTACLE FOR THE LATTER

[75] Inventors: Walter Barth; Erich Borst; Winfried Helm; Manfred Stäbler, all of Leinfelden-Echterdingen, Fed. Rep. of Germany

[73] Assignee: Robert Bosch GmbH, Stuttgart, Fed. Rep. of Germany

[21] Appl. No.: 347,808

[22] PCT Filed: Sep. 5, 1987

[86] PCT No.: PCT/DE87/00407

§ 371 Date: Apr. 28, 1989

§ 102(e) Date: Apr. 28, 1989

[87] PCT Pub. No.: WO88/03077

PCT Pub. Date: May 5, 1988

[30] Foreign Application Priority Data

Oct. 28, 1986 [DE] Fed. Rep. of Germany ..... 3636601

[51] Int. Cl.[5] ..... B24B 23/02

[52] U.S. Cl. ..... 51/170 T; 51/268

[58] Field of Search ..... 51/170 T, 268, 262, 51/271; 83/478; 30/390

[56] References Cited

U.S. PATENT DOCUMENTS 4,574,532 3/1986 Häberle et al. ..... 51/268

*Primary Examiner*—M. Rachuba

*Attorney, Agent, or Firm*—Michael J. Striker

[57] ABSTRACT

A protective hood assembly for a grinding machine comprising a protective hood having a predetermined size corresponding to the predetermined diameter of the grinding disc; a fastening receptacle attachable to the grinding machine housing and having a shoulder for receiving the protective hood; and a member for securing the protective hood on the shoulder and including a locking portion, the shoulder of the fastening receptacle having an opening for receiving the locking portion upon fastening of the securing member on the shoulder, at least one of shape, arrangement, number, and size of the locking portion and the opening corresponding to the locking portion, being selected in accordance with the predetermined size of the protective hood in such a way as to prevent mounting on the fastening receptacle protective hoods having a size exceeding the predetermined size of the protective hood.

18 Claims, 5 Drawing Sheets

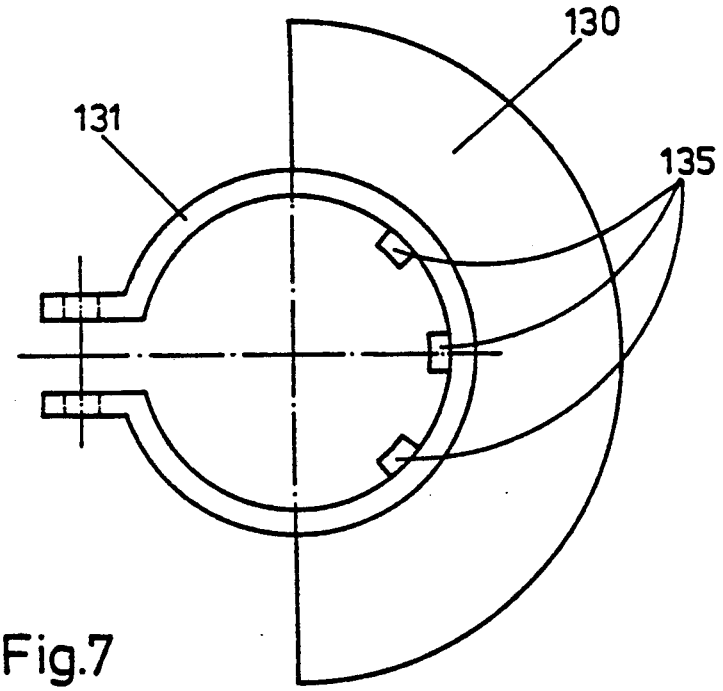
Fig.7
Fig.9
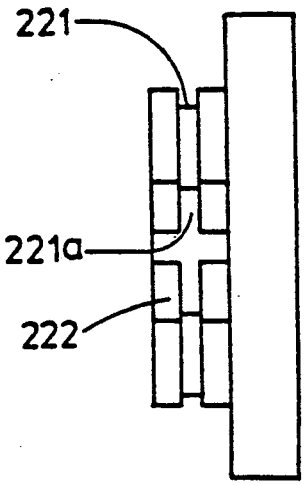
Fig.8
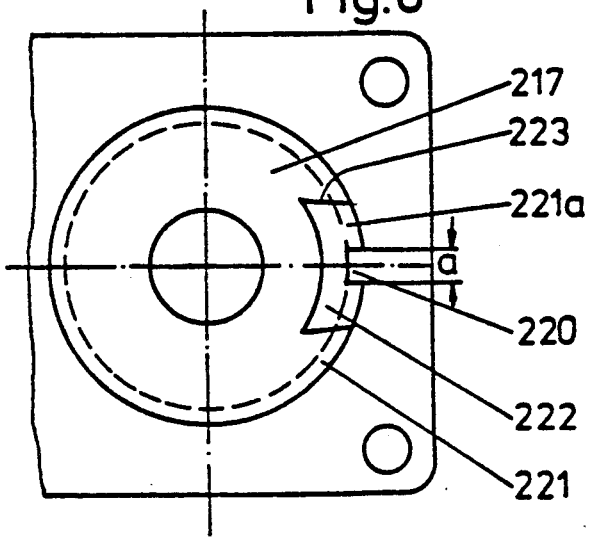
Fig.10
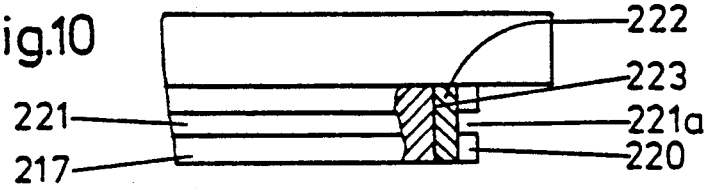

PROTECTIVE HOOD FOR GRINDING MACHINES, PARTICULARLY ANGLE GRINDERS, AND SUITABLE FASTENING RECEPTACLE FOR THE LATTER

BACKGROUND OF THE INVENTION

The invention relates a protective hood for grinding machines, particularly for angle grinders, and a suitable fastening receptacle for the latter. In grinding machines, an allowable circumferential speed of the clamped-in grinding disk should not be exceeded. The maximum allowable grinding disk diameter is dependent on the normal speed of the machine. Thus, taking this into account, only grinding disks up to a maximum allowable diameter may be clamped in. In order to be able to exert influence over this, it is known that grinding machines which are smaller with respect to their output are dimensioned so as to be smaller, with respect to a cylindrical fastening shoulder, than machines having a higher output. Accordingly, only protective hoods whose securing part is likewise dimensioned so as to be correspondingly small fit on the smaller fastening shoulder. Such small protective hoods then only allow grinding disks to be clamped on which are, at most, the same size as, but not larger than, the protective hood. It is known, according to this principle, to effect rough gradations with two different diameters of the fastening shoulder. Aside from the fact that such a rough gradation is insufficient, variously dimensioned cast parts, different machine adjustments while utilizing the machine, and also different suitably fitting accessories are necessary. This is costly and cumbersome. Because of the need for different machine adjustments during the machining, handling becomes impractical.

SUMMARY OF THE INVENTION

The object of the invention is to provide a protective hood for grinding machines, particularly angle grinders, and suitable fastening receptacle for the latter, in which coding is provided with simple means between the grinding machine, specifically its fastening shoulder, on one hand, and the protective hood, specifically its securing part, on the other hand, the coding being designed in such a way that smaller protective hoods can be mounted, but not protective hoods which are larger than the maximum allowable. The clamping collar diameter of the fastening shoulder has always the same size. Therefore, a single part, which generally consists of a cast part, is sufficient for the fastening receptacle. The reduction of the individual parts leads to a reduction in cost and a simplification of storage. In addition, because of the constant clamping collar diameter, a simplification and reduction of the accessories is also achieved. Further, it is ensured that the user of a grinding machine which allows a larger protective hood, per se, corresponding to its output and coding, can also attach a smaller protective hood, as desired, at any time, which e.g. is desirable for reasons of handiness. This advantage also results from the clamping collar diameter of the fastening shoulder, which diameter is the same for all sizes.

The present invention as to its construction so to its mode of operation, together with additional objects and advantages thereof, will be best understood from the following description of the preferred embodiments with reference to the accompanying drawings.

BRIEF DESCRIPTION OF THE DRAWING

FIG. 7 shows a top view of a protective hood similar to that of FIG. 5 which fits with the fastening receptacle of FIG. 6, according to the second embodiment;

FIG. 8 shows a bottom view of a part of a fastening receptacle similar to that of FIG. 2, according to a third embodiment;

FIG. 9 shows a side view of the fastening receptacle of FIG. 8;

FIG. 10 shows a partially sectional top view of the receptacle of FIG. 8;

DESCRIPTION OF THE PREFERRED EMBODIMENTS

Figure 1:
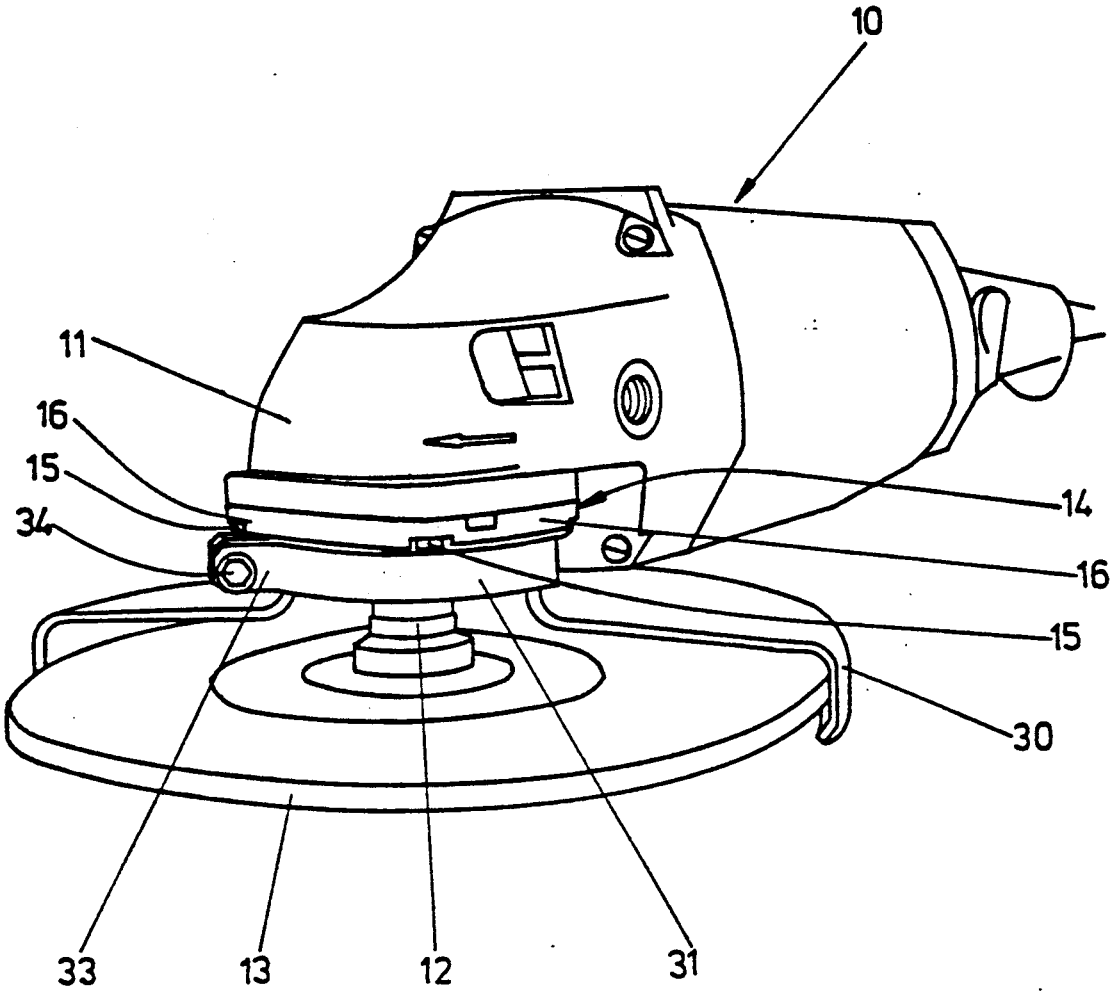
FIG. 1 shows a schematically perspective view of a manually operated angle grinder including a hood according to the present invention.
Figure 2:
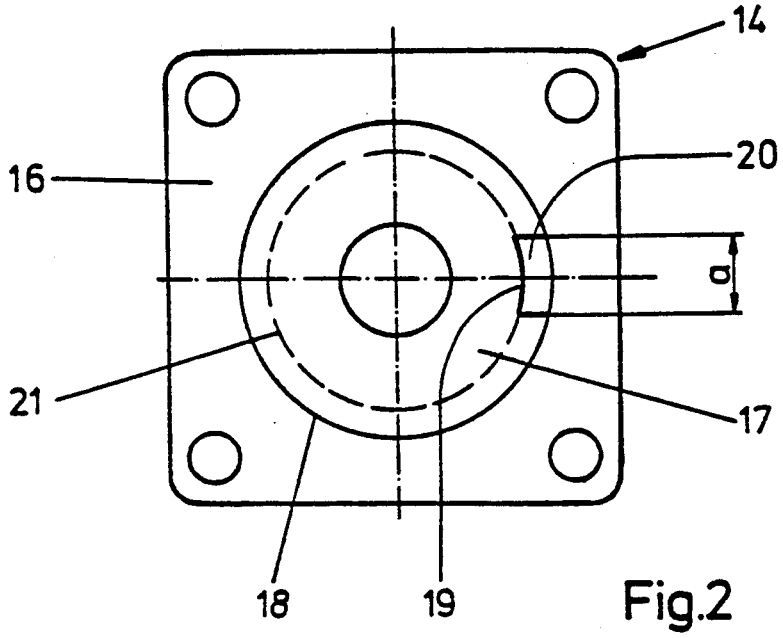
FIG. 2 shows a bottom view only of the fastening receptacle of the angle grinder of FIG. 1, according to a first embodiment.
Figure 3:
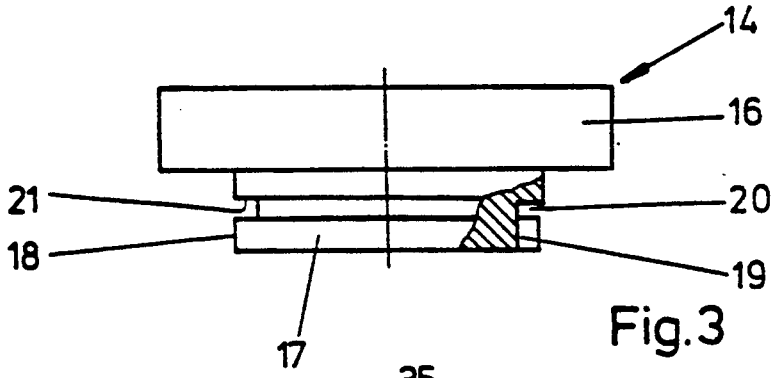
FIG. 3 shows a partially sectional side view of the fastening receptacle of the angle grinder of FIG. 2.

In FIG. 1, a manually operated angle grinder 10 is shown as an example of a grinding machine; at its housing 11, where the drive shaft 12 for the grinding disk 13 projects, a fastening receptacle 14 is screwed on by screws 15 which penetrate a flange 16 of the fastening receptacle 14. The flange 16 carries a cylindrical fastening shoulder 17 which is penetrated in the center by the drive shaft 12 and comprises an outer circumferential surface 18 which is at least substantially smooth. The fastening receptacle 14 consists e.g. of a cast part.

A protective hood 30 is fastened on the fastening shoulder 17 of the fastening receptacle 14 with a securing part 31 arranged on the protective hood 30. The securing part 31 consists e.g. of a clamping strap which forms one piece with the protective hood 30, consists of sheet metal and extends along a circumferential angle of approximately 320° and carries clamping brackets 32, 33 which are bent at the end and can be clamped together with a clamping screw 34 in order to tighten the securing part 31. The body of the protective hood 30 extends along a circumferential angle of approximately 180° and provides a protective covering for the grinding disk 13. Prior to tightening the clamping screw 34, the protective hood 30 is swiveled on the cylindrical fastening shoulder 17 into the position which is favorable for the aforementioned machining operation and offers the best protection by the protective hood 30 for the surroundings and particularly for the user.

With grinding disks such as those used in the shown angle grinder 10, the allowable circumferential speed of the grinding disk 13 should not be exceeded. The maximum allowable diameter of the grinding disk 13 which is inserted in the angle grinder 10 is thus dependent on the rated speed of the angle grinder 10. With the first embodiment in FIGS. 1–5, it is explained below how only grinding disks 13 up to a maximum allowable diameter can be clamped in each instance when the size of the protective hood 30 corresponds to the rated speed of the angle grinder 10.

The securing part 31 of the protective hood 30 comprises at least one locking member 35 which projects out in the radial direction in the first embodiment.

In another embodiment, not shown, the locking member 35 projects out in the axial direction instead.

The fastening shoulder 17 comprises, an opening 19 in which the locking member 35 can engage when fastening the securing part 31 on the fastening shoulder 17. The opening 19 is formed in this instance as an axially directed insertion opening 20 which is open toward the free end of the fastening shoulder 17 and in which the assigned locking member 35 engages when the securing part 31 of the protective hood 30 is placed on axially. The locking member 35 and the corresponding insertion opening 20 are selected with respect to their shape and size as a function of the protective hood size determined by the rated speed of the grinding machine. The locking member 35 fits into the insertion opening 20 so as to ensure that a protective hood 30 of this type can be attached to the angle grinder 10. Protective hoods which are smaller, for example, and in which the locking member is dimensioned so as to be smaller than the insertion opening 20 can also be arranged at the angle grinder 10, since this locking member also fits into the insertion opening 20. However, such protective hoods which are dimensioned so as to be larger than the protective hood 30 and accordingly have a larger locking member than the locking member 35 cannot be fastened at the fastening shoulder 17, because this larger locking member does not fit into the insertion opening 20. Accordingly, the user is prevented from fastening protective hoods at the fastening shoulder 17 which are larger than allowable and, accordingly, clamping on larger grinding disks than are allowable in accordance with the rated speed of the angle grinder 10.

When considering a range of angle grinders 10 with different rated speeds, these angle grinders comprise fastening shoulders 17 which are identical in size, but which vary with respect to the shape and/or dimensions of the insertion opening 20. In a corresponding assignment, there are protective hoods 30 of different sizes for these angle grinders, their securing part 31 being dimensioned so as to be the same size, so that it fits on the fastening shoulder 17 but comprises locking members 35 which are dimensioned so as to be different in shape and/or size.

The locking members 35 of one size only fit in assigned insertion openings 20 which are identical to or larger than the respective locking member 35. On the other hand, a locking member 35 which is dimensioned so as to be larger than the insertion opening 20 does not fit into the latter.

In the first embodiment shown in FIGS. 2–5, the width b of the locking member 35 measured in the circumferential direction and the width a of the respective insertion opening 20 measured in the same direction vary corresponding to different protective hood sizes. Accordingly, for example, a wide locking member 35 is provided for a large protective hood size, a medium-wide locking member 35 is provided for a medium protective hood size, and a small locking member 35 is provided for a small protective hood size. Respectively, the fastening shoulder 17 for a large protective hood size with a wide locking member 35 has a wide insertion opening 20, a medium-wide insertion opening 20 for a medium protective hood size with a medium-wide locking member 35, and a narrow insertion opening 20 for a small protective hood size with a narrow locking member 35. Accordingly, it is ensured that e.g. a protective hood of a large size with wide locking member cannot be fastened on an angle grinder whose fastening shoulder 17 has a medium-wide or narrow insertion opening 20, because such an angle grinder 10 has a low rated speed and, accordingly, only those grinding disks 13 can be clamped in which have a smaller diameter than grinding disks for other angle grinders, for which the large protective hood size with wide locking member 35 is provided.

In the first embodiment, the fastening shoulder 17 comprises an outer annular groove 21 which is normally provided for receiving a locking projection which is arranged at the securing part 31 and is directed radially inward from this location as an axial securing of the attached protective hood 30. In principle, this axial securing by using the annular groove 21 and the locking projection at the securing part 31 is achieved by the insertion opening 20, on one hand, and the locking member 35, on the other hand, regardless of the aforementioned coding, according to the invention.

A particular simplification results when the locking projection available for the axial securing is designed to simultaneously serve as a locking member 35 and when the annular groove 21 for axial securing is formed so as to simultaneously serve as an opening 19 for receiving the locking member 35.

Figure 11:
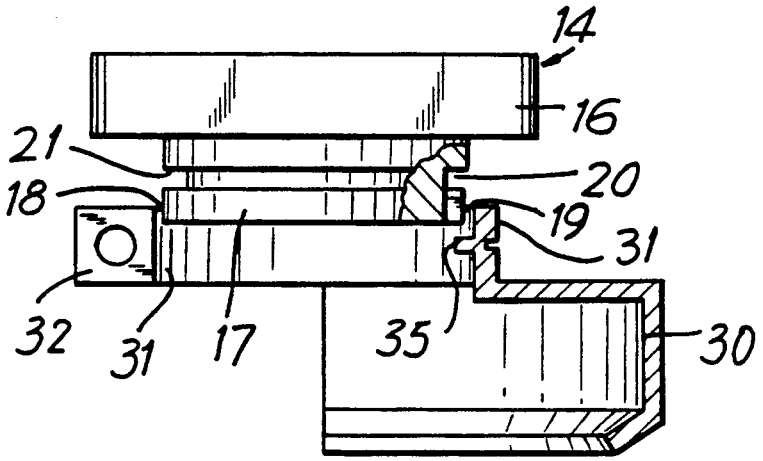
FIG. 11 shows the protective hood mounted on a fastening shoulder of the fastening receptacle but not yet fixed thereto.
Figure 12:
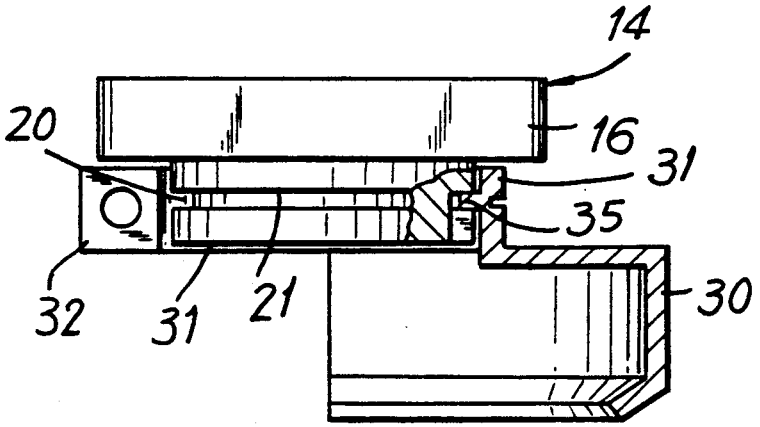
FIG. 12 shows the protective hood being secured on the shoulder of the fastening receptacle.

In the first embodiment shown in FIGS. 1–5, the axial insertion opening 20 leads up to the annular groove 21 into which it opens. After mounting the protective hood on the shoulder 17 of the fastening receptacle as shown in FIG. 11, when the locking member 35 is axial engagement in the insertion opening 20, the locking member 35 can engage in the annular groove 21 approximately in the manner of a bayonet-type engagement, as shown in FIG. 12 by rotating the protective hood 30 with securing part 31, so that the aforementioned axial securing of the fastening is achieved.

Figure 4:
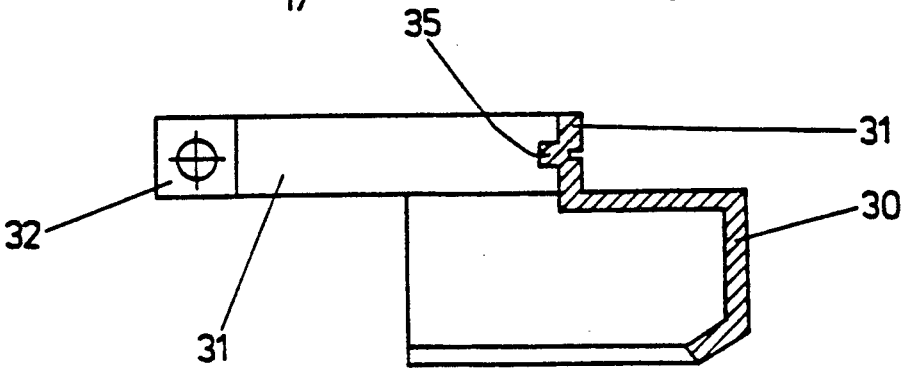
FIG. 4 shows a sectional view of a protective hood of the grinding machine of FIG. 1 according to a first embodiment and, which fits with the fastening receptacle.
Figure 5:
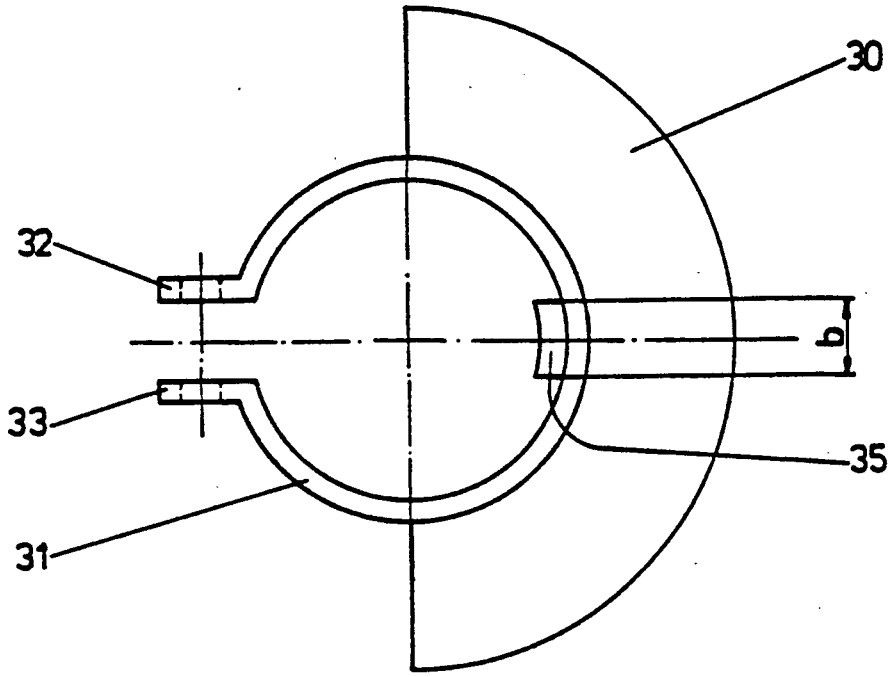
FIG. 5 shows a top view of the protective hood of FIG. 4.

In another embodiment, not shown, the axially directed insertion opening 20 is omitted. The fastening shoulder 17 is only equipped with the annular groove 21 which serves simultaneously as opening for the aforementioned coding. Thus, as shown in FIGS. 4 and 5, the protective hood 30 comprises the locking member 35 which projects out radially and can engage in the annular groove 21 simultaneously for the purpose of axial securing when, after attaching the protective hood 30, the latter is rotated on the fastening shoulder 17 in such a way that the locking member 35 arrives in the annular groove 21 in the circumferential direction. In this embodiment, the thickness of the locking member 35, as measured in the axial direction, and the assigned axially measured width of the annular groove 21 vary corresponding to the different protective hood sizes for the coding for the aforementioned purpose.

Thus, in this embodiment, not shown, a thick locking member 35 is provided for a large protective hood size, a medium-thick locking member 35 is provided for a medium protective hood size, and a thin locking member 35 is provided for a small protective hood size.

Respectively, the fastening shoulder 17 then comprises a wide annular groove 21 for a large protective hood size with thick locking member 35, a medium-wide annular groove 21 for a medium protective hood size with medium-thick locking member 35, and a narrow annular groove 21 for a small protective hood size with a thin locking member 35. This embodiment has the advantage that the same type of fastening receptacle 14 can always be manufactured, e.g. as a cast part, whose coding can first be effected subsequently during the machining, specifically in that a respective wide, medium-wide or narrow annular groove can be provide when cutting in the annular groove 21.

In another embodiment, not shown, the amount by which the locking member 35 projects out radially, on one hand, and the depth of the annular groove 21, on the other hand, can be utilized for the coding.

In another embodiment, not shown, combinations of the aforementioned coding are also possible. Thus, for example, the width b of the locking member 35 as measured in the circumferential direction and, in addition, the thickness of the locking member 35 as measured in the axial direction can be utilized for coding. In the fastening shoulder 17, respectively, the width a of the insertion opening 20 as measured in the circumferential direction, on one hand and, in addition, the width of the annular groove 21 is decisive for the coding.

Figure 6:
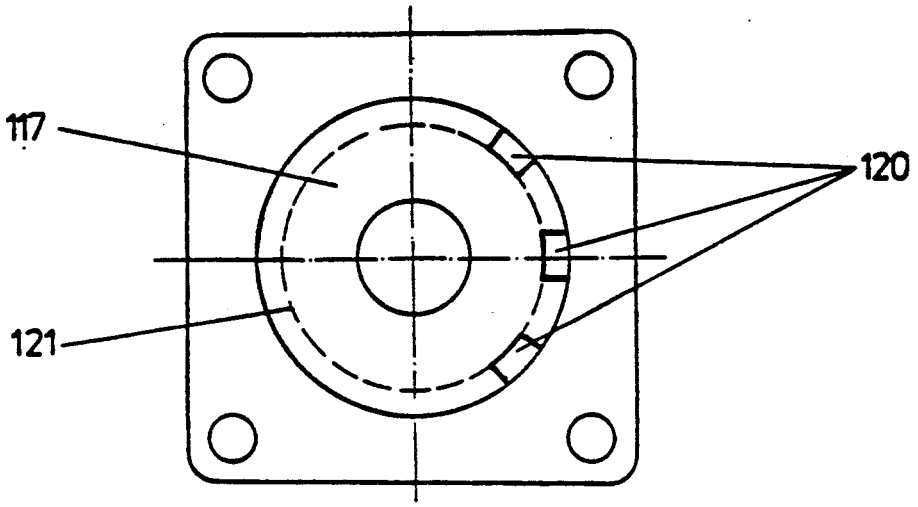
FIG. 6 shows a bottom view of a fastening receptacle of a second embodiment which is similar to that shown in FIG. 2.

In the second embodiment shown in FIGS. 6 and 7, reference numbers which are increased by 100 are used for the parts corresponding to respective parts of the first embodiment example, so that the description of the first embodiment can accordingly be referred to while avoiding repetition.

In the second embodiment shown in FIGS. 6 and 7, the securing part 131 of the protective hood 130 comprises a plurality of locking members 135 arranged at a distance from one another in the circumferential direction. Respectively, the cylindrical fastening shoulder 117 which is provided on the machine comprises a plurality of insertion openings 120 which open into the annular groove 121. The insertion openings 120 are arranged at the same distance from one another with respect to the circumferential angle as the locking members 135. Their width, as measured in the circumferential direction, is dimensioned in the same way as that of the locking members 135. The coding can be effected in this instance via the number of locking members 135 of the securing part 131. Thus, for example, three locking members 135 are provided for a large protective hood size, as shown in FIG. 7. On the other hand, there are only two locking members 135 for a medium protective hood size and only one locking member 135 for a small protective hood size. Respectively, the fastening shoulder 117 for a large protective hood size with three locking members 135 comprises three insertion openings 120 which fit the latter, as shown in FIG. 6. For a medium protective hood size with only two locking members 135, the fastening shoulder 117 comprises only two insertion openings 120 which fit them, and for a small protective hood size with one locking member 135 there is only one insertion opening 120 which fits it. All the locking members 135 e.g. have the same dimensions.

In the third embodiment shown in FIGS. 8–10, the cylindrical fastening shoulder 217 comprises an insert 222 which contains at least one axially directed insertion opening 220 and, in addition, an annular groove part 221*a* which adjoins the remaining part of the annular groove 221. The insert 222 is inserted in an axial receptacle 223 of the fastening shoulder 217 in an exact fit. The receptacle 223 and the insert 222 are designed in an approximately dovetail-shaped manner, as seen in axial section, so that the insert 222, when slid into the receptacle 223 axially, can move neither inward nor outward in the radial direction.

The insert 222 is constructed as a plastics molded part. The shape and dimensioning of the receptacle 223 of the fastening shoulder 217 is identical for all inserts 222. The inserts 222 vary to the extent that they comprise insertion openings 220 which are dimensioned with different widths in the circumferential direction depending upon the size of the machine, as is described with reference to the first embodiment.

Also in this embodiment, the number and/or shape and/or size of the insertion opening 220 can be used for coding, wherein the dimensioning in the radial direction and/or axial direction and/or circumferential direction are to be included.

The third embodiment has the advantage that a single cast part for the fastening receptacle can be used for different sizes and types of grinding machines, specifically also in its final machining. The coding of the fastening shoulder 217 in the desired dimension is then first effected during the final assembly, e.g. at the assembly belt, by inserting the respective assigned insert 222. Also, in after-sales servicing, only a single part is necessary for the fastening receptacle with respective assigned inserts 222. The respective inserts 222 can be additionally distinguished by different colors and can carry indications of the diameter assigned to these colors, so that the correct protective hood assignment can be recognized at a glance.

In all of the embodiments, the fastening shoulder 17, 117, 217 always has the same diameter regardless of the size of the machine. Accordingly, protective hoods already in service, whose securing part 31, 131 is still without a locking member, also fit on such fastening shoulders. In addition, it is possible for the user not only to use the respective fitting protective hood size, but also to install smaller protective hoods at any time, e.g. for reasons of handiness. In every case, it is ensured with simple means and practically without high additional costs that protective hoods which are smaller than, but not larger than, the maximum allowable protective hoods which determine the maximum allowable grinding disk diameter can be installed in grinding machines, particularly angle grinders, which allow a maximum allowable grinding disk diameter depending on the nominal speed of the machine.

While the invention has been illustrated and described as embodied in a protective hood assembly for an angle grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A protective hood assembly for a grinding machine having a predetermined nominal rotational speed and including a housing a shaft projecting from the housing for receiving at a free end thereof a grinding disc having a predetermined diameter corresponding to the nominal rotational speed of the grinding machine, said protective hood assembly comprising a protective hood having a predetermined size corresponding to the predetermined diameter of the grinding disc; and a fastening receptacle attachable to the grinding machine housing and having a shoulder for receiving said protective hood; said protective hood including a portion for securing said protective hood on said shoulder, and locking means comprising a predetermined number of locking members arranged on said securing portion in a predetermined manner with each locking member having a predetermined shape and size, at least one of the predetermined number of said locking members, the predetermined manner of arrangement of said locking members, the predetermined size of each locking member, and the predetermined shape of each locking member defining the predetermined size of said protective hood, said shoulder of said fastening receptacle including opening means for receiving said locking means, comprising a predetermined number of openings, and arranged in a predetermined manner with each opening having a predetermined size and a predetermined shape, at least one of the predetermined number of said openings, the predetermined arrangement of said opening means, the predetermined size of each opening, and the predetermined shape of each opening being selected to correspond to said at least one of the predetermined number of locking members, the predetermined manner of arrangement of the locking members, the predetermined size of each locking member, and the predetermined shape of each locking member defining the predetermined size of said protective hood, respectively, in such a way as to prevent mounting on said fastening receptacle protective hoods having a size exceeding said predetermined size while permitting mounting on said fastening receptacle protective hoods having a size smaller than said predetermined size of said protective hood.

2. A protective hood assembly according to claim 1, wherein said opening means comprises one opening having a predetermined dimension, said locking means comprising one locking member received in said one opening and having a dimension which is identical to or less than the predetermined dimension of said opening.

3. A protective hood assembly according to claim 2, wherein said locking member projects at least in one of axial and radial directions.

4. A protective hood assembly according to claim 1, wherein said opening means comprises an outer annular groove, said locking means comprising an inwardly directed radial projection received in said outer annular groove.

5. A protective hood assembly according to claim 1, wherein said opening means comprises an opening extending in axial direction, said locking means comprising a locking member received in said axially extending opening upon axial mounting of said protective hood.

6. A protective hood assembly according to claim 5, wherein said opening means further comprises an annular groove, said axially extending opening opens into said annular groove, and said locking member engages into said annular groove in bayonet-type engagement manner after being received in said axially extending opening upon rotation of said protective hood.

7. A protective hood assembly according to claim 4, wherein said axially extending opening and said locking member have a respective circumferential width which vary in accordance with the predetermined size of protective hoods.

8. A protective hood assembly for a grinding machine having a predetermined nominal rotational speed and including a housing and a shaft projecting from the housing for receiving at a free end thereof a grinding disc having a predetermined diameter corresponding to the nominal rotational speed of the grinding machine, said protective hood assembly comprising a protective hood having a predetermined size corresponding to the predetermined diameter of the grinding disc; and a fastening receptacle attachable to the grinding machine housing and having a shoulder for receiving said protective hood; said protective hood including a portion for securing said protective hood on said shoulder, and locking means comprising a predetermined number of locking members arranged on said securing portion in a predetermined manner with each locking member having a predetermined shape and size, at least one of the predetermined number of said locking members, the predetermined manner of arrangement of said locking members, the predetermined size of each locking member, and the predetermined shape of each locking member defining the predetermined size of said protective hood, said shoulder of said fastening receptacle including opening means for receiving said locking means, comprising a predetermined number of openings, and arranged in a predetermined manner with each opening having a predetermined size and a predetermined shape, at least one of the predetermined number of said openings, the predetermined arrangement of said openings, the predetermined size of each opening, and the predetermined shape of each opening being selected to correspond to said at least one of the predetermined number of locking members, the predetermined manner of arrangement of the locking members, the predetermined size of each locking member, and the predetermined shape of each locking member defining the such a way as to prevent mounting on said fastening receptacle protective hoods having a size exceeding said predetermined size while permitting mounting on said fastening receptacle protective hoods having a size smaller than said predetermined size of said protective hood, said opening means comprising an opening extending in axial direction, said locking means comprising a locking member received in said axially extending opening upon axial mounting of said protective hood, and said axially extending opening and said locking member each having a respective dimension which is directly proportional to the predetermined size of said protective hood.

9. A protective hood assembly for a grinding machine having a predetermined nominal rotational speed and including a housing and a shaft projecting from the housing for receiving at a free end thereof a grinding disc having a predetermined diameter corresponding to the nominal rotational speed of the grinding machine, said protective hood assembly comprising a protective hood having a predetermined size corresponding to the predetermined diameter of the grinding disc; and a fastening receptacle attachable to the grinding machine housing and having a shoulder for receiving said protective hood; said protective hood including a portion for securing said protective hood on said shoulder, and locking means comprising a predetermined number of locking members arranged on said securing portion in a predetermined manner with each locking member having a predetermined shape and size, at least one of the predetermined number of said locking members, the predetermined manner of arrangement of said locking members, the predetermined size of each locking member, and the predetermined shape of each locking member defining the predetermined size of said protective hood, said shoulder of said fastening receptacle including opening means for receiving said locking means, comprising a predetermined number of openings, and arranged in a predetermined manner with each opening having a predetermined size and a predetermined shape, at least one of the predetermined number of said openings, the predetermined arrangement of said opening means, the predetermined size of each opening, and the predetermined shape of each opening being selected to correspond to said at least one of the predetermined number of locking members, the predetermined manner of arrangement of the locking members, the predetermined size of each locking member, and the predetermined shape of each locking member defining the predetermined size of said protective hood, respectively, in such a way as to prevent mounting on said fastening receptacle protective hoods having a size exceeding said predetermined size while permitting mounting on said fastening receptacle protective hoods having a size smaller than said predetermined size of said protective hood, said predetermined number of locking members including three locking members for a large protective hood size, two locking members for a medium protective hood size, and one locking member for a small protective hood size, and said predetermined number of openings including three openings for a large protective hood size, two openings for medium protective hood size, and one opening for a small protective hood size.

10. A protective hood assembly according to claim 9, wherein all locking members have the same dimensions.

11. A protective hood assembly for a grinding machine having a predetermined nominal rotational speed and including a housing and a shaft projecting from the housing for receiving at a free end thereof a grinding disc having a

12. A protective hood assembly according to claim 11, wherein said opening means comprises an axially extending opening.

13. A protective hood assembly according to claim 11, wherein said shoulder comprises a shoulder portion for receiving said insert, said insert being selected from a plurality of different inserts having different dimensions for different size openings, and said shoulder portion having a dimension and shape which are the same for all of said plurality of different inserts.

14. A protective hood assembly according to claim 13, wherein said shoulder portion has a substantially dovetail cross-sectional shape, said insert having a cross-sectional shape corresponding to said substantially dovetail cross-sectional shape of said shoulder portion.

15. A protective hood assembly according to claim 11, wherein said insert is a plastic molded part.

16. A protective hood assembly for a grinding machine having a predetermined nominal rotational speed and including a housing and a shaft projecting from the housing for receiving at a free end thereof a grinding disc having a predetermined diameter corresponding to the nominal rotational speed of the grinding machine, said protective hood assembly comprising a protective hood having a predetermined size corresponding to the predetermined diameter of the grinding disc; and a fastening receptacle attachable to the grinding machine housing and having a shoulder for receiving said protective hood; said protective hood including a portion for securing said protective hood on said shoulder, and locking means comprising a predetermined number of locking members arranged on said securing portion in a predetermined manner with each locking member having a predetermined shape and size, at least one of the predetermined number of said locking members, the predetermined manner of arrangement of said locking members, the predetermined size of each locking member, and the predetermined shape of each locking member defining the predetermined size of said protective hood, said shoulder of said fastening receptacle including opening means for receiving said locking means, comprising a predetermined number of openings, and arranged in a predetermined manner with each opening having a predetermined size and a predetermined shape, at least one of the predetermined number of said openings, the predetermined arrangement of said opening means, the predetermined size of each opening, and the predetermined shape of each opening being selected to correspond to said at least one of the predetermined number of locking members, the predetermined manner of arrangement of the locking members, the predetermined size of each locking member, and the predetermined shape of each locking member defining the predetermined size of said protective hood, respectively, in such a way as to prevent mounting on said fastening receptacle protective hoods having a size exceeding said predetermined size while permitting mounting on said fastening receptacle protective hoods having a size smaller than said predetermined size of said protective hood, said opening means comprises one opening having a predetermined dimension, said locking means comprising one locking member received in said one opening and having a dimension which is identical to or less than the predetermined dimension of said opening, said locking member having a thickness and said opening having a width both selected in accordance with the predetermined size of said protective hood, a thick locking member being provided for a large protective hood size, a medium-thick locking member being provided for a medium protective hood size, and a thin locking member being provided for a small protective hood size, and said opening having a large width for a large protective hood size, a medium width for a medium protective hood size, and a narrow width for a small protective hood size.

17. A protection kit of hoods protective for grinding machines having different predetermined nominal speeds and each grinding machine including a housing and a shaft projecting from the housing for receiving at a free end thereof a grinding disc having a predetermined diameter corresponding to a predetermined nominal speed of a respective grinding machine, said protection kit comprising a plurality of protective hoods having different predetermined sizes corresponding to respective predetermined diameters of the grinding discs; and fastening receptacle means attachable to the grinding machine housings and having a shoulder for receiving a respective protective hood, said respective protective hood including a portion for securing said respective protective hood on said shoulder, said securing portion having locking means having a dimension corresponding to the predetermined size of the respective protective hood, said shoulder having opening means having a dimension corresponding to the dimension of said locking means for receiving said locking means upon fastening of said respective protective hood on said shoulder whereby mounting on said shoulder protective hoods having different predetermined sizes exceeding the predetermined size of said respective protective hood is prevented and mounting on said shoulder protective hoods having different predetermined sizes less than the predetermined size of said respective protective hood is possible.

18. A protective hood assembly according to claim 2, wherein said locking member has a thickness and said opening has a width both selected in accordance with the predetermined size of said protective hood.

* * * * *